United States Patent [19]

Ishiguro

[11] Patent Number: 4,555,913

[45] Date of Patent: Dec. 3, 1985

[54] ICE PRODUCT MAKING MACHINE

[75] Inventor: Fumio Ishiguro, Toyohashi, Japan

[73] Assignee: Hoshizaki Electric Co., Ltd., Toyoake, Japan

[21] Appl. No.: 661,328

[22] Filed: Oct. 16, 1984

[30] Foreign Application Priority Data

Oct. 17, 1983 [JP] Japan ..... 58-159379[U]

[51] Int. Cl.[4] ..... F25C 1/12

[52] U.S. Cl. ..... 62/347

[58] Field of Search ..... 62/347, 348, 74

[56] References Cited

U.S. PATENT DOCUMENTS

| | | | |
|---|---|---|---|
| 3,430,452 | 3/1969 | Dedricks et al. | 62/137 X |
| 4,412,429 | 11/1983 | Kohl | 62/347 |
| 4,442,681 | 4/1984 | Fischer | 62/347 |
| 4,459,824 | 7/1984 | Krueger | 62/347 |

*Primary Examiner*—William E. Tapolcai

*Attorney, Agent, or Firm*—Wenderoth, Lind & Ponack

[57] ABSTRACT

An ice product making machine or apparatus has a pair of freezing plates arranged vertically and in a facing relation to each other. These freezing plates are provided with a plurality of rib-like partitions extending in the downflow direction of the ice making water, flat freezing sections defined between the adjoining partitions of the freezing plates, a cooling coil mounted in direct mechanical contact with the back sides of the respective freezing plates, and a flushing water feed pipe mounted to an upper portion of the freezing plates. These partitions are arranged in a staggered relation to one another so that the partitions and freezing sections of the one freezing plate are confronted by the freezing sections and partitions of the other freezing plate, respectively.

1 Claim, 6 Drawing Figures

ICE PRODUCT MAKING MACHINE

BACKGROUND OF THE INVENTION

This invention relates to an ice product making machine or apparatus and, more particularly, to such a machine or apparatus in which a pair of freezing plates are arranged substantially vertically and in which flushing spray water is used for efficiently releasing ice products from the flat freezing sections of the freezing plates.

The typical construction of the vertical type ice product making machine or apparatus is shown in FIGS. 1 and 2.

In the prior-art ice product making machine shown in FIGS. 1 and 2, a freezing unit 1 is comprised of a generally box-like freezing mold 2 and a cooling coil 3 affixed to the back side of the mold 2. The freezing mold 2 has a large number of freezing cells 4 defined by vertical partition plate members 2*b* and downwardly inclined horizontal partition plate members 2*a*. The freezing mold 2 is fabricated in its entirety of copper or the like thermal conductive material.

The above described freezing mold 1 is built into an automatic ice product making machine shown in FIG. 1. A water saucer 5 is provided at a lower portion of the automatic ice product making machine 1. The ice-making water filled in the tank 5 is supplied to the freezing mold 2 by means of a circulating pump 6 via a connecting hose 7 and a water feed tube 8. The refrigerant or cooling medium is supplied into the coil 3 through a compressor 10 and a condenser 11 provided in a housing 9 so that the mold 2 is chilled and the ice cubes are formed in the cells 4, these ice cubes being then stored in an ice cube storage tank 12 provided to the lower portion of the housing 9.

This known ice product making apparatus has a serious drawback that the freezing mold 2 is highly sophisticated in structure thus raising the costs of the overall apparatus.

The arrangement shown in FIGS. 3 (A) and (B) has been proposed as a means for obviating the drawback of the above described conventional device.

A strip 2 of a metal material having lower thermal conductivity, such as stainless steel is formed with uniformly spaced apart rib-like portions 2*c*. A pair of such strips 2 are placed vertically with their back sides 2*d* facing to each other and a meandering cooling coil 3 is provided in a space 2*e* between the plates 2. The freezing flat sections 2*f* are defined between the adjoining partitions 2*c* of the freezing plate 2.

Since the partitions 2*c* on one of the plate 2 are spaced apart by the same transverse distance as the partitions of the other plate, the partitions of the freezing plates 2, 2 are correctly in register with one another.

Thus, during the freezing process, the ice making water is supplied in circulation from the water supply pipe 8 mounted at an upper portion of the narrow space 2*e* between the plates 2 and gradually chilled and frozen as shown in FIG. 3(B), so that substantially semi-cylindrical ice products are formed separately from one another at the portions of the freezing sections 2*f* contacted with the cooling coil 3. In the defrost or harvesting process, flushing water is supplied to the back sides 2*d* of the freezing plates 2 through flush water outlet apertures 8*a* formed in the bottom wall portion of the supply pipe 8. Thus the temperature of the freezing plates 2 is raised slightly for promoting the harvesting process. The flushing water, however, is not caused to flow along the back sides of the freezing sections 2*f* of the plates 2 where the demand for the flushing water should be maximum, but only through channels or grooves 2*g* defined at the back sides of the confronting partitions 2*c*. Thus, in an ice product making machine with a lower hot gas supply capacity or devoid of a hot gas supply system, a longer harvesting time is required, so that the daily output capacity of ice making is lowered.

SUMMARY OF THE INVENTION

It is a principal object of the present invention to provide an extremely effective means for eliminating the above described deficiencies of the prior art apparatus. According to the present invention, the partitions of a pair of freezing plates are provided in a staggered relation to one another in such a manner that the flat freezing sections of one of the freezing plates are confronted by the partitions of the other plate, so that an improvement is achieved in the harvesting capacity of the apparatus.

DESCRIPTION OF THE PREFERRED EMBODIMENT

The freezing unit or mold according to the present invention is hereinafter explained by referring to the accompanying drawings, in which the same numerals are used to depict the same or equivalent parts.

Figure 1:
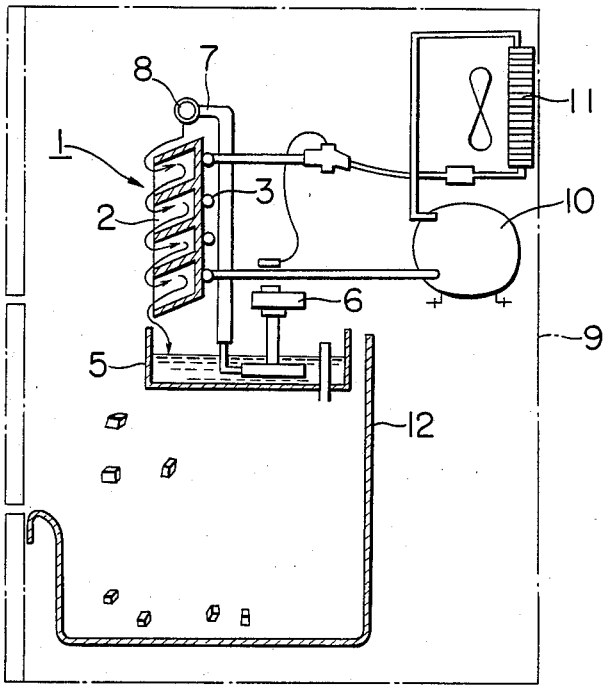
FIG. 1 (PRIOR ART)
FIG. 1 is a schematic side elevation showing the overall ice product making machine according to the prior art.
Figure 2:
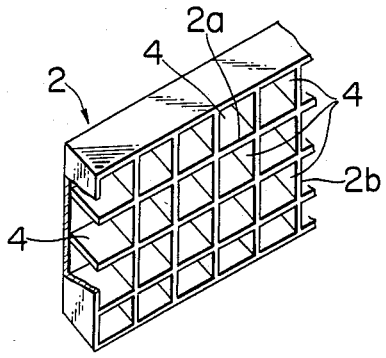
FIG. 2 (PRIOR ART)
FIG. 2 is a perspective view of the freezing mold employed in the ice product making machine shown in FIG. 1.
Figure 3A:
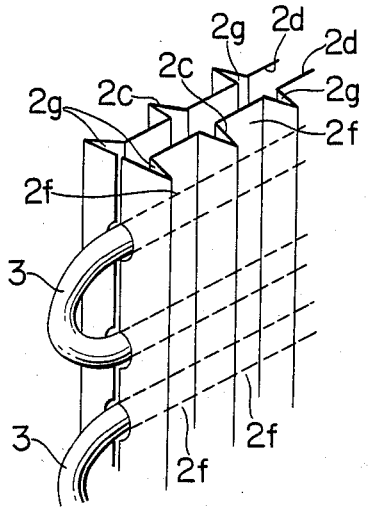
FIGS. 3 (A), (B) show a portion of another example of the freezing mold according to the prior art, in a partial perspective view and a cross-sectional view, respectively.
Figure 3B:
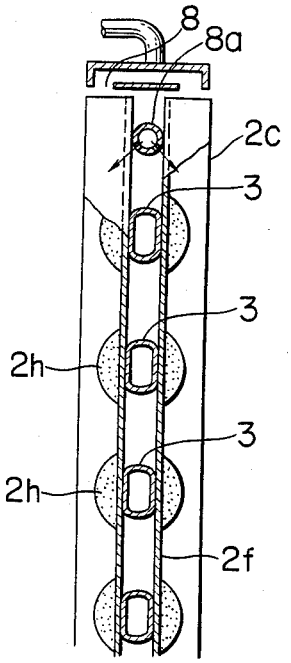
Figure 4:
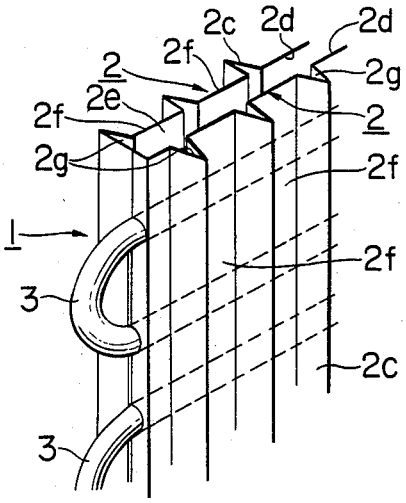
FIG. 4 is a partial perspective view of the freezing mold according to the present invention.

Referring to FIG. 4, a freezing unit or mold 1 has a pair of substantially upright freezing plates 2 and a meandering refrigerant pipe or cooling coil 3. Each freezing plate 2 is fabricated of a metal material of lower thermal conductivity, such as stainless steel. On the surface of each freezing plate 2, there are integrally formed a plurality of rib-like partitions 2*c* that extend vertically with a constant transverse interval from one another for interrupting heat transmission axially of the cooling coil 3 caused by direct mechanical contact with the coil. These freezing plates 2, 2 are arranged with their back sides 2*d* facing each other. The cooling coil 3 is held in an interstice 2*e* defined between the plates 2, 2 and maintained in direct mechanical contact with the back sides of the plates.

The partitions 2*c* are provided at a constant transverse interval on the surface of the freezing plate 2 so that freezing sections 2*f* oriented in the same general direction as the partitions 2*c* are defined between these partitions. Moreover, the partitions of the one freezing plate are positioned in a dephased or staggered relation with respect to those of the other freezing plate when seen in a plane view, so that the partitions 2c and freezing sections 2f of the one freezing plate face to the freezing sections and partitions of the other freezing plate, respectively. In other words, the back side of each freezing section 2f of the one freezing plate is confronted by an opening or groove at the reverse side of each partition 2c of the other freezing plate.

Figure 5:
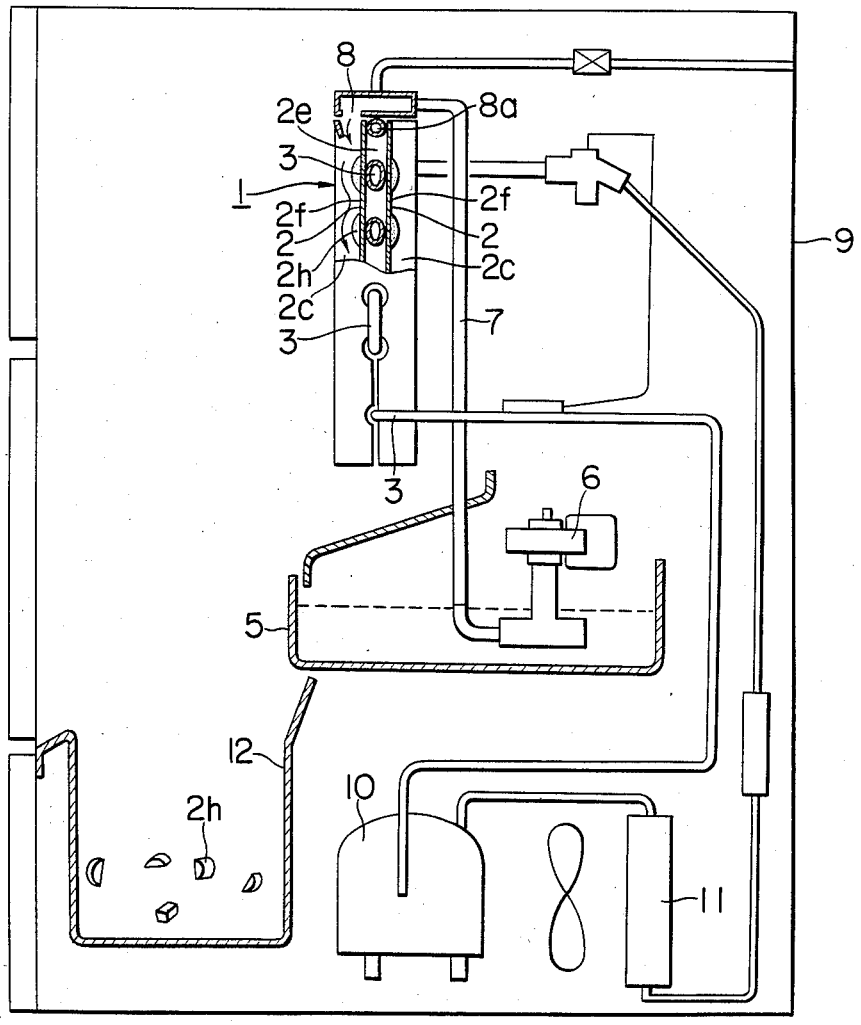
FIG. 5 is a schematic side elevation showing the freezing mold of FIG. 4 mounted to an ice product making machine.

The above described freezing mold 1 can be built into an automatic ice product making machine or apparatus 1 shown in FIG. 5. The apparatus has a water source or reservoir 5 at a lower portion thereof for accommodating ice-making water. During ice making, the ice-making water in the saucer 5 is supplied by a circulating pump 6 to the surface of the freezing plate 2 via a connecting hose 7 and a water feed pipe 8. The refrigerant or cooling medium is supplied to the coil 3 by a compressor 10 and a condenser 11 provided in a housing 9. In this manner, the freezing plates 2 are chilled, and a number of substantially semi-cylindrical ice products 2h are formed on each freezing section 2g.

During harvesting, flushing water is supplied from a flushing water feed pipe 8a mounted below the feed pipe 8, and is caused to flow down along the grooves 2g of the partitions 2c of one of the freezing plates 2. In as much as these grooves 2g are confronted by the flat reverse sides 2d of the freezing sections 2f of the other freezing plate 2, the flushing water is also caused to flow in a sufficient quantity along these reverse sides 2d. As a result, the temperature of the freezing sections 2f is raised, so that the ice products 2h can be released in a shorter time even in instances where a hot gas is not used for harvesting simultaneously with the flushing water. The ice products thus detached from the freezing sections are stored in a bin 12.

From the foregoing it is seen that the arrangement according to the present invention provides a water spray unit in which the flushing water flowing down along the grooves at the back sides of the respective partitions of one of the freezing plate is also caused to flow down along the back sides of freezing sections of the other plate confronting thereto, so that the amount of the flushing water than can be supplied to the back sides of the freezing sections can be increased drastically as compared to the conventional freezing mold with a resultingly improved harvesting capacity.

What is claimed is:

1. A freezing mold for an ice product making apparatus comprising a pair of freezing plates mounted in opposition to each other and having a plurality of vertically extending and transversely spaced apart rib-like partitions which extend outwardly from the freezing surface of the freezing plates and which form vertically extending grooves on the back side of the freezing plates, said freezing plates having flat freezing sections defined between adjacent partitions, a cooling coil in direct mechanical contact with the back surfaces of the flat freezing sections of the freezing plates, and a flushing water feed pipe mounted on an upper portion of and between the freezing plates, and wherein the partitions and flat freezing sections of the freezing plates are arranged in a staggered relation to each other in a manner such that the partitions and the flat freezing sections of one freezing plate respectively are directly opposite the flat freezing sections and partitions respectively of the other freezing plate and wherein flushing water supplied through the said flushing water feed pipe effectively contacts both the said vertically extending grooves and the back surfaces of the flat freezing sections of said freezing plates.

* * * * *